United States Patent [19]

Jones

[11] Patent Number: 4,860,445

[45] Date of Patent: Aug. 29, 1989

[54] METHOD OF MOUNTING ELECTRICAL CONTACTS IN CONNECTOR BODY

[75] Inventor: Gerald M. Jones, Titusville, Pa.

[73] Assignee: GTE Products Corporation, Stamford, Conn.

[21] Appl. No.: 308,064

[22] Filed: Feb. 9, 1989

[51] Int. Cl.[4] ..... H01R 9/16

[52] U.S. Cl. ..... 29/842; 156/73.1; 156/580.1; 174/52.4; 357/74

[58] Field of Search ..... 29/878, 877, 879, 842; 357/74; 174/52.4; 439/68

[56] References Cited

U.S. PATENT DOCUMENTS 3,735,214 5/1973 Renskers et al. ..... 174/52.4 X

FOREIGN PATENT DOCUMENTS 2207629 9/1987 Japan ..... 156/73.1

*Primary Examiner*—Timothy V. Eley

*Assistant Examiner*—Carl J. Arbes

*Attorney, Agent, or Firm*—William H. McNeill

[57] ABSTRACT

In a method of fixing an electrical contact into a connector body, said connector body having at least one relatively thin-walled portion including a plurality of transversely extending slots, each of said slots including oppositely disposed wings upstanding from said thin-walled portion; and an electrical contact portion in said slot and extending normal thereto and projecting therefrom, the steps comprising: positioning said connector body and its attendent contacts at a work station; engaging said contacts with an alignment plate to position said contacts at the rearwardmost portion of said slots; lifting said connector body and alignment plate until the projecting portions of said contacts engaging mating apertures in an ultrasonic horn, said horn having ribs which engage said wings; and ultrasonically vibrating said horn to melt said wings and substantially close said slots, thereby securing said contacts.

3 Claims, 2 Drawing Sheets

METHOD OF MOUNTING ELECTRICAL CONTACTS IN CONNECTOR BODY

TECHNICAL FIELD

This invention relates to electrical connectors and more particularly to a method of mounting electricals contacts within a connector body.

BACKGROUND ART

Fixing electrical contacts within insulating connectors is often troublesome. Many techniques have been employed, including force fitting; i.e., friction; molding the connector body around the contacts; and by heating the body to melt some of the material around a contact. Friction fitting can damage the contact; insert molding is expensive, and melting by the direct application of heat is cumbersome and time-consuming.

DISCLOSURE OF THE INVENTION

It is, therefore, an object of the invention to obviate the disadvantages of the prior art.

It is another object of the invention to enhance the art of connector making.

Yet other objects of the invention are to provide a fast, simple, and economical method for fixing electrical contacts into connector bodies.

These objects are accomplished, in one aspect of the invention, by the provision of a method of fixing an electrical contact into a connector body, said connector body having at least one relatively thin-walled portion including a plurality of transversely extending slots, each of said slots including oppositely disposed wings upstanding from said thin-walled portion; and an electrical contact portion in said slot and extending normal thereto and projecting therefrom, the steps comprising: positioning said connector body and its attendent contacts at a work station; engaging said contacts with an alignment plate to position said contacts at the rearwardmost portion of said slots; lifting said connector body and alignment plate until the projecting portions of said contacts engaging mating apertures in an ultrasonic horn, said horn having ribs which engage said wings; and ultrasonically vibrating said horn to melt said wings and substantially close said slots, thereby securing said contacts.

This method is extremely fast and reliable and is well suited for mass production and inclusion in an automatic assembly operation.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
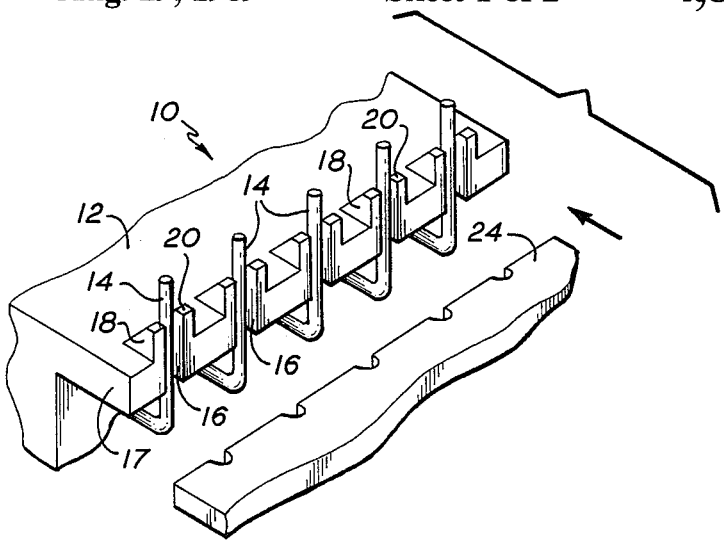
FIG. 1 is a perspective view, with some parts omitted, of a connector used with the invention.
Figure 2:
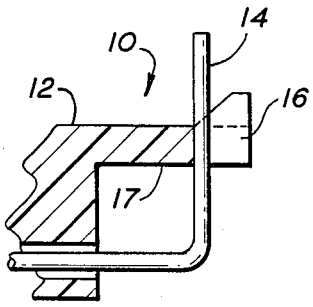
FIG. 2 is a cross-sectional, elevational view of the connector.
Figure 3:
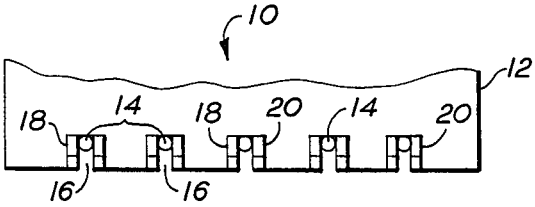
FIG. 3 is a partial plan view of the connector.

Referring now to the drawings with greater particularity, there is shown in FIG. 1 a connector 10 having an electrically insulating body 12 containing a plurality of electrical contacts, the tail ends 14 of which are shown. The ends 14 are shown as being formed at a right angle, although this is exemplary only, each having an extending leg substantially captured in a slot 16 which is formed in a relatively thin-walled portion 17 of body 12. The slots 16 extend transversely and each slot has associated therewith oppositely disposed wings 18 and 20. These wings project upwardly from the thin-walled portion 17.

Figure 7:
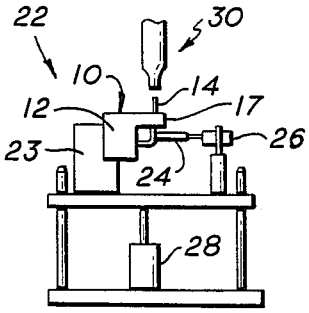
FIG. 7 is a diagrammatic elevational view of apparatus necessary to carry out the method.

To fix the contact ends 14 within the slots 16, the connector 10 is positioned at a work station 22 (see FIG. 7), within a positioning block 23. The contacts are engaged by an alignment plate 24, which can be actuated by fluid motor 26, to move the contacts to the rearmost position in the slots 16 and apply sufficient pressure against the connector 10 to seat it in positioning block 23. The connector 10 and alignment plate 24 are lifted, by virtue of fluid motor 28, until the contact ends 14 penetrate suitable apertures in an ultrasonic horn 30.

Figure 4:
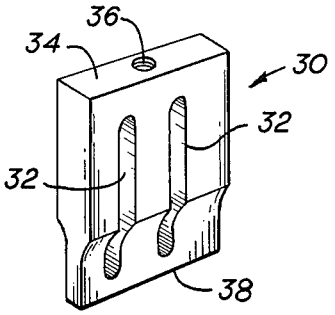
FIG. 4 is a perspective view of an ultrasonic horn.
Figure 5:
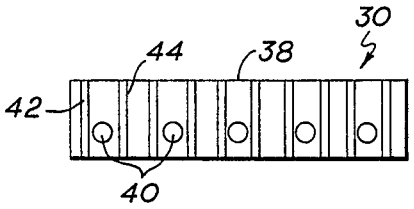
FIG. 5 is a plan view of the horn of FIG. 4.
Figure 6:
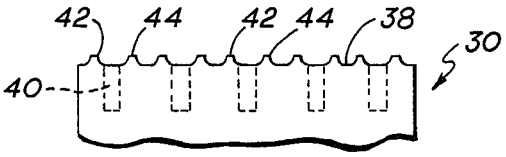
FIG. 6 is a partial, side elevational view of the horn.
Figure 8:
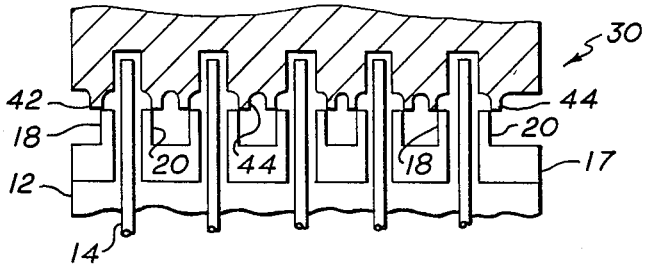
FIG. 8 is a sectional view of a mated horn and connector during the contact fixing operation.

The horn 30 is shown in FIG. 4 and comprises a steel member which can have tuning slots 32 formed therein. The upper surface 34 is provided with a threaded bore 36 for attachment to the ultrasonic frequency providing apparatus (not shown). The lower end 38 of horn 30 mates with the contact ends 14 and is provided with a like number of contact end receiving apertures 40, each aperture being flanked by ribs 42 and 44. When mated with a connector 10 (see FIG. 8) the ribs 42 and 44 overlie wings 18 and 20.

Figure 9:
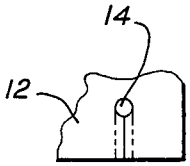
FIG. 9 is a partial plan view of a single contact after the ultrasonic welding has been performed.

Upon energization of the ultrasonic horn, the wings 18 and 20 melt and flow into the slot 16, substantially filling the same and fixing the contact ends in position (see FIG. 9).

In a preferred embodiment of the invention, the ultrasonic apparatus uses a Dukane 1500 watt, 60,000 pulse thruster with a 0.6 to 1 booster. With such a system vibrating the horn at 60,000 cycles per second, the entire operation takes three seconds. The melting alone is accomplished in about two seconds. During the operation a slight upward pressure is provided by fluid motor 28 to aid in the flow of the wings 18 and 20.

There is thus provided a fast, efficient system and method for staking or fixing electrical contacts in a connector body.

While there have been shown what are at present considered to be the preferred embodiments of the invention, it will be apparent to those skilled in the art that various changes and modifications can be made herein without departing from the scope of the invention as defined by the appended claims.

I claim:

1. In a method of fixing an electrical contact into a connector body, said connector body having at least one relatively thin-walled portion including a plurality of transversely extending slots, each of said slots including oppositely disposed wings upstanding from said thin-walled portion; and an electrical contact portion in said slot and extending normal thereto and projecting therefrom, the steps comprising: positioning said connector body and its attendent contacts at a work station; engaging said contacts with an alignment plate to position said contacts at the rearwardmost portion of said slots; lifting said connector body and alignment plate until the projecting portions of said contacts engaging mating apertures in an ultrasonic horn, said horn having ribs which engage said wings; and ultrasonically vibrating said horn to melt said wings and substantially close said slots, thereby securing said contacts.

2. The method of claim 1 wherein said horn vibrates at a frequency of 60,000 cycles per second.

3. The method of claim 2 wherein said horn vibrates for about two seconds.

* * * * *